United States Patent [19]

Ichikawa

[11] 4,282,594

[45] Aug. 4, 1981

[54] ELECTRONIC TIMEPIECE

[75] Inventor: Singo Ichikawa, Tanashi, Japan

[73] Assignee: Citizen Watch Company Limited, Tokyo, Japan

[21] Appl. No.: 99,881

[22] Filed: Dec. 3, 1979

[30] Foreign Application Priority Data

Dec. 27, 1978 [JP] Japan ..... 53-160064
Jan. 8, 1979 [JP] Japan ..... 54-1163

[51] Int. Cl.[3] ..... G04C 19/00; G04B 17/12

[52] U.S. Cl. ..... 368/82; 368/201

[58] Field of Search ..... 368/69, 185, 186, 187, 368/189, 200–212

[56] References Cited

U.S. PATENT DOCUMENTS

| | | | |
|---|---|---|---|
| 3,916,612 | 11/1975 | Morokawa et al. | 368/201 |
| 4,023,344 | 5/1977 | Mukaiyama | 368/187 |
| 4,055,945 | 11/1977 | Schwarzschild | 368/201 |
| 4,101,838 | 7/1978 | Aihara et al. | 368/63 |
| 4,141,208 | 2/1979 | Witipple et al. | 368/187 |
| 4,154,053 | 5/1979 | Cheteliat et al. | 368/201 |

*Primary Examiner*—Vit W. Miska
*Attorney, Agent, or Firm*—Holman & Stern

[57] ABSTRACT

An electronic timepiece is equipped with a frequency division ratio adjustment circuit controlled by switch means, for producing a running rate correction signal that is aperiodically added in frequency to the output of a standard frequency oscillator, to correct the running rate of the timepiece, and is provided with externally controlled gate means for inhibiting this aperiodic frequency addition, so that the actual frequency of the standard frequency oscillator may be measured by means such as an external monitoring device which detects a display drive or modulation signal frequency through electrostatic or electromagnetic coupling to the timepiece display.

7 Claims, 8 Drawing Figures

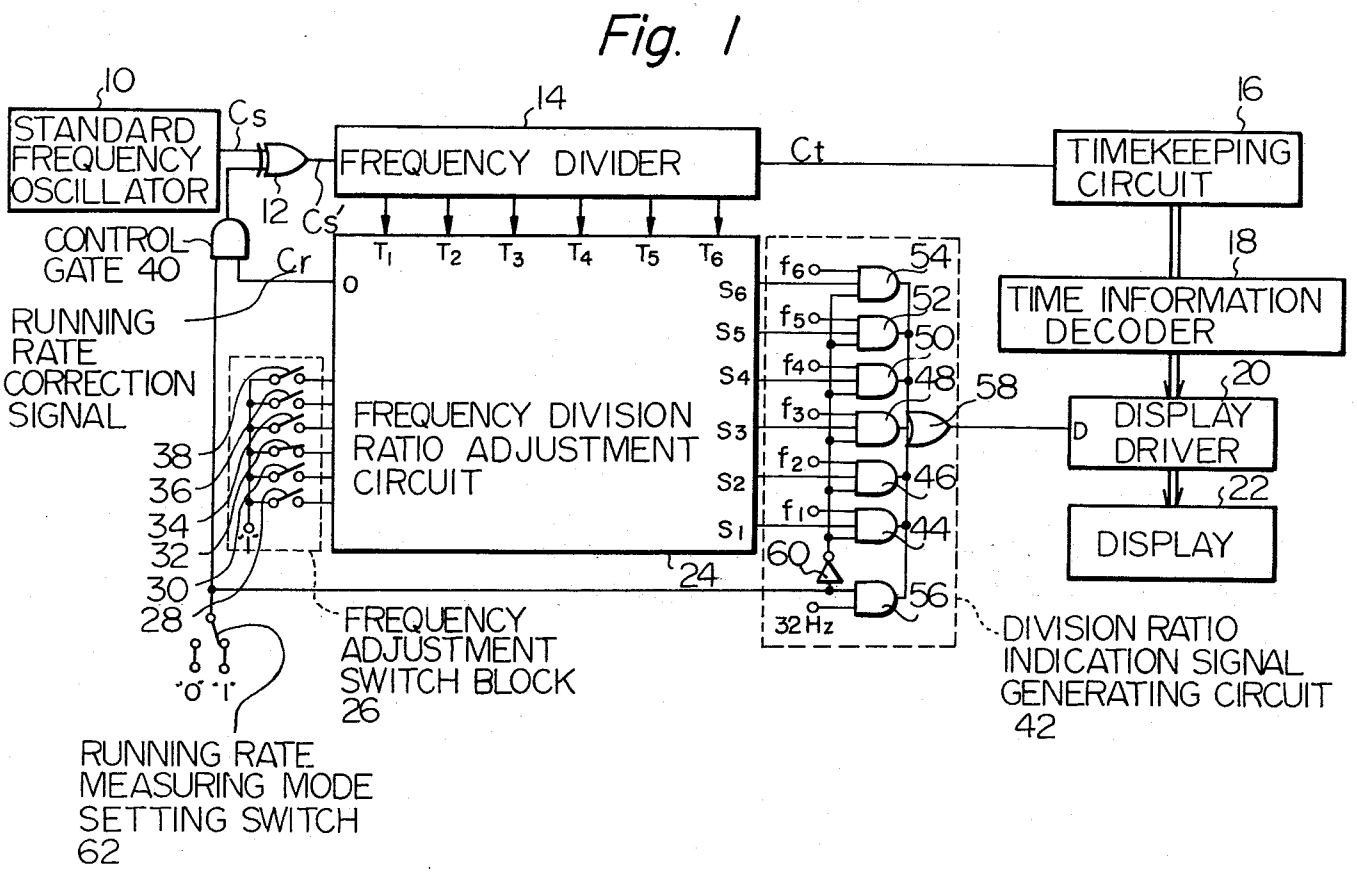
Fig. 1
STANDARD FREQUENCY OSCILLATOR
10
Cs
12
Cs'
FREQUENCY DIVIDER
14
Ct
TIMEKEEPING CIRCUIT
16
TIME INFORMATION DECODER
18
DISPLAY DRIVER
20
DISPLAY
22
DIVISION RATIO INDICATION SIGNAL GENERATING CIRCUIT
42
FREQUENCY DIVISION RATIO ADJUSTMENT CIRCUIT
24
FREQUENCY ADJUSTMENT SWITCH BLOCK
26
CONTROL GATE 40
Cr
RUNNING RATE CORRECTION SIGNAL
RUNNING RATE MEASURING MODE SETTING SWITCH
62
32Hz FREQUENCY DIVISION RATIO ADJUSTMENT CIRCUIT 24
RATE CORRECTION INFORMATION DECODER
92
T1
T2
T3
T4
T5
T6
S1
S2
S3
S4
S5
S6
39
37
35
33
31
29
0
74
72
70
68
66
64
76
78
80
82
84
86
88

ELECTRONIC TIMEPIECE

BACKGROUND OF THE INVENTION

An important consideration in the design of an electronic timepiece is the method by which the running rate of the timepiece is to be adjusted and measured, at the time of manufacture or at some subsequent time. The most commonly used method hitherto has been to provide a trimmer capacitor in the standard frequency quartz crystal oscillator circuit of the timepiece, and to adjust this trimmer capacitor in order to vary the output frequency from the standard frequency oscillator, to thereby modify the running rate of the timepiece. This method has the disadvantage that, since the capacity value of the trimmer must remain very stable over a long period of time, in order to ensure stability of the running rate of the timepiece, the trimmer capacitor is a relatively expensive component. An alternative method which has been proposed for adjusting the running rate of an electronic timepiece has been to vary the frequency division ratio of the frequency divider circuit of the timepiece, so that the frequency of a unit time signal produced by the frequency divider circuit is correct. The necessity for adjusting the frequency of the standard frequency quartz crystal oscillator circuit of the timepiece is thereby obviated. The most simple and economical method of adjusting the frequency division ratio of the frequency divider in an electronic timepiece is to select a number of signals of different frequency produced by the frequency divider circuit and to combine these to produce a running rate correction signal of suitable frequency. This running rate correction signal is then added aperiodically in frequency to the output signal from the standard frequency oscillator of the timepiece, and the resultant signal is input to the frequency divider circuit.

Such a method would appear to offer various advantages over the use of a trimmer capacitor for running rate adjustment. However, up to the present, such a method of running rate adjustment has not come into widespread use. The principal reason for this is that, since the signal which is input to the frequency divider (and hence, signals subsequently produced by the frequency divider) are aperiodic, it is extremely difficult to measure the running rate of the timepiece quickly and easily. In the case of an electronic timepiece of conventional design, for example, in which the signals applied to the timekeeping and display section of the timepiece are periodic, it is possible to measure the running rate of the timepiece rapidly and easily while the timepiece is in a completely assembled and operating state. This can be accomplished, for example, by means of an external monitoring device such as is disclosed in U.S. Pat. No. 3,946,591 by Yanagawa et al. This device includes a sensor which is capacitatively coupled to the electro-optical display device of an electronic timepiece by being brought into proximity with the timepiece dial, and which detects the frequency of a modulation signal applied to electrodes of the electro-optical display. Since this modulation signal frequency is a known submultiple of the frequency of the standard frequency oscillator of the timepiece, the actual running rate of the timepiece can be readily derived from the sensor output signal. Such a method cannot be applied to a timepiece in which the modulation signal frequency is aperiodically modified, due to the use of variable frequency division as discussed above, since it would be necessary to monitor the average modulation signal frequency over an excessively long time period in order to attain any accuracy in estimating the actual effective running rate of the timepiece. This is due to the fact that the aperiodic frequency correction is conducted only relatively infrequently, corresponding to correction by a few seconds per day or per week, for example.

With the present invention, the above disadvantages of utilizing an aperiodic frequency addition method of timepiece running rate correction are eliminated. This is achieved by providing means whereby the aperiodic frequency addition process can be inhibited, by actuation of an external operating member, so that signals produced by the frequency divider circuit of the timepiece are all periodic, and are integral multiples of the frequency of the standard frequency oscillator output signal. In addition, the present invention enables the actual amount of rate correction performed by aperiodic frequency addition of a running rate correction signal to be derived, either by direct display on the timepiece, or by means of an external monitoring device.

SUMMARY OF THE INVENTION

According to the present invention, an electronic timepiece is provided with a frequency divider for dividing the frequency of a standard frequency signal to thereby provide a unit time signal. A timekeeping circuit processes the unit time signal to produce time information, which is applied to display drive means and to a display device. In the embodiments of the present invention described herein, the display device is an electro-optical display, however it is also possible to apply the present invention to a timepiece having a stepping motor which drives time indicating hands. A frequency division ratio adjustment circuit receives several signals of different frequencies from the frequency divider circuit and combines these in accordance with the setting of combination of frequency adjustment switches to produce a running rate correction signal. The running rate correction signal is aperiodically added to the output signal from a standard frequency oscillator circuit, whereby the effective frequency division ratio of the frequency divider circuit (averaged over a sufficiently long period of time) is made such that the average frequency of a unit time signal produced by the frequency divider circuit is precisely adjusted to a predetermined value (e.g. one Hz). A control gate is provided between the frequency division ratio adjustment circuit and the frequency addition circuit, which is controlled by an externally actuated switch. When this switch is set to one position, the running rate correction signal is passed through the control gate, to be aperiodically added to the standard frequency oscillator output. When the switch is in another position, the control gate inhibits the running rate correction signal from being added to the standard frequency signal, so that all signals produced by the frequency divider circuit are made periodic. In this mode of operation, the combination of signal frequencies which have been selected by the frequency adjustment switches can be displayed directly on the timepiece display, or can be deduced by utilizing an external frequency monitoring device, such as that of Yanagawa et al which has been referred to hereinabove.

BRIEF DESCRIPTION OF THE DRAWINGS

In the attached drawings:

FIG. 1 is a block circuit diagram of a first embodiment of an electronic timepiece according to the present invention;

DESCRIPTION OF THE PREFERRED EMBODIMENTS

Figure 2:
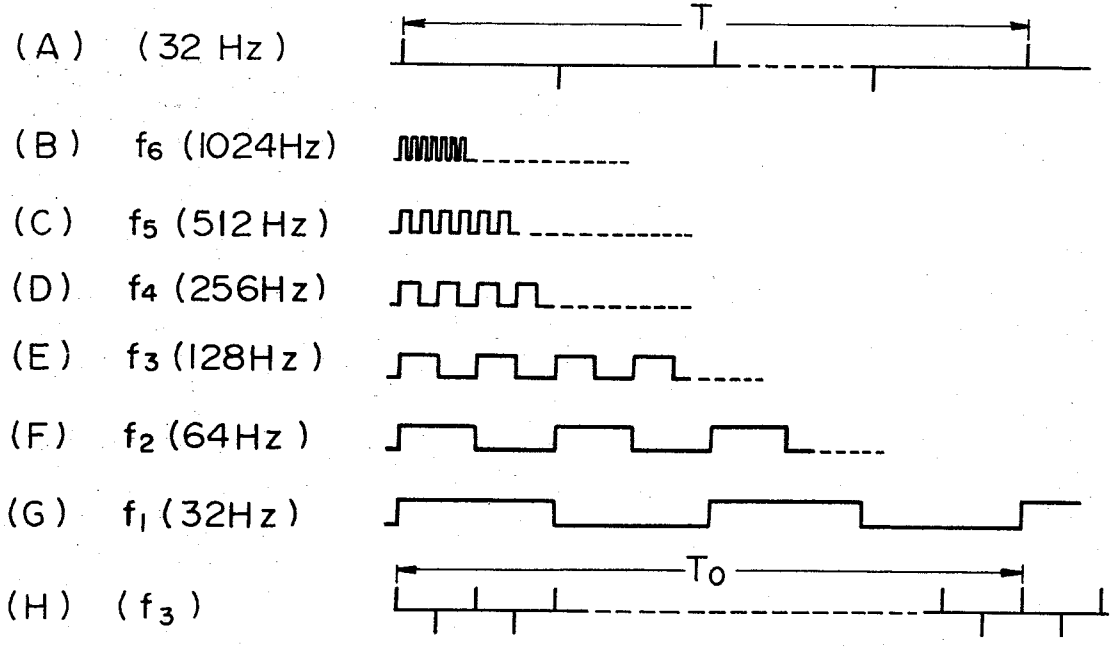
FIG. 2 is a waveform diagram illustrating various signals generated in the circuit of FIG. 1.

Referring now to FIG. 1, a simplified block circuit diagram of a first embodiment of the present invention is shown. This is an electronic timepiece having a source of a standard frequency signal, comprising a quartz crystal oscillator circuit, designated by reference numeral 10. A standard frequency signal is produced by standard frequency oscillator circuit 10, and is input to an exclusive-OR gate 12, which is used for aperiodic frequency addition purposes, as explained hereinafter. The output signal from gate 12 is applied to the input terminal of a frequency divider circuit 14, and is frequency-divided therein to provide a unit time signal of predetermined frequency, such as 1 Hz. The unit time signal, designated as Ct, is input to a timekeeping circuit 16, which thereby computes various time information. This time information is applied to a time information decoder circuit 18, which accordingly produces suitably coded signals for input to a display driver circuit 20. Drive signals from display driver circuit 20 are applied to electrodes of an electro-optical display device 22, consisting of a liquid crystal display cell.

Reference numeral 24 denotes a frequency division ratio adjustment circuit, which receives a set of six signals from frequency divider circuit 14, each of a different frequency, at terminals T1 to T6 respectively. A frequency adjustment switch block 26, composed of frequency adjustment switches 28 to 38, controls frequency division ratio adjustment circuit 24 to combine the signals applied to terminals T1 to T6 to produce a signal designated as the running rate correction signal Cr, on terminal 0 of frequency division ratio adjustment circuit 24. The running rate correction signal Cr is applied to one input of an AND gate 40, which serves as a control gate, to inhibit or enable the running rate correction signal Cr to be applied to exclusive-OR gate 12, to be aperiodically added in frequency to the output signal from standard frequency oscillator 10.

Control gate 40 is controlled by a switch 62, which functions as a running rate measuring mode setting switch. Running rate measuring mode setting switch 62 is controlled by an external operating member. When the output from switch 62 is at the "1" potential, the control gate 40 is enabled to pass the running rate correction signal Cr to exclusive-OR gate 12. In this case, the output signal from exclusive-OR gate 12 will consist of the standard frequency signal from oscillator 10, modified by aperiodic frequency addition by the running rate correction signal Cr. Thus, the various signals produced by frequency divider 14 will not be completely periodic, over a long period of time, but the frequency of running rate correction signal Cr is set (by means of frequency adjustment switch block 26) such that the frequency of the unit time signal Ct output from frequency divider circuit 14 has a predetermined frequency to a high degree of accuracy, when measured over a relatively long period of time.

When the output from running rate measuring mode setting switch 62 is at the "0" level, then control gate 40 is inhibited from passing the running rate correction signal Cr to exclusive-OR gate 12. Thus, the output signal from standard frequency oscillator 10 is applied without modification to frequency divider circuit 14. In this case, all of the output signals from frequency divider circuit 14 are purely periodic.

Reference numeral 42 denotes a division ratio indicating signal generating circuit, which comprises a set of AND gates 44 to 54, the outputs of which are applied to an OR gate 58, and an inverter 60. Terminals S1, S2, S3, S4, S5 and S6 are applied to inputs of AND gates 44, 46, 48, 50, 52 and 54 respectively, and are connected to frequency adjustment switches 28, 30, 32, 34, 36 and 38 respectively. Thus, for example, when frequency adjustment switch 32 is set to produce a "1" level output, a "1" level input signal is applied to AND gate 48 from terminal S3 of division ratio indicating signal generating circuit 42. Signals f1 to f6 are input to AND gates 44, 46, 48, 50, 52 and 54 respectively, and have frequencies of 32 Hz to 1024 Hz respectively, as shown in the waveform diagram of FIG. 2. Signals f1 to f6 are generated by frequency divider circuit 14. A 32 Hz signal, also produced by frequency divider circuit 14, is applied to an input of AND gate 56 of division ratio indicating signal generating circuit 42. The output of running rate measuring mode setting switch 62 is applied to the other input of AND gate 56, and also to the input of inverter 60. The output of inverter 80 is applied to inputs of each of AND gates 44 to 54 in division ratio indicating signal generating circuit 42. Thus, it can be seen that with the timepiece is operating in the normal timekeeping mode, i.e. when running rate measuring mode setting switch 62 is set to produce a "1" level signal, then a normal modulation signal of 32 Hz is applied from the output of AND gate 56 of division ratio indicating signal generating circuit 42, through OR gate 58, to terminal D of display driver circuit 20. The signal applied to terminal D of display driver circuit 20 serves to cause the display driver 20 to apply alternating drive pulses to liquid crystal display 22.

If, on the other hand, the running rate measuring mode setting switch 62 is set to produce a "0" level signal, i.e. the timepiece is placed in the running rate measuring mode, then AND gate 56 of division ratio indicating signal generating circuit 42 will be inhibited, and the output of inverter 60 will go to the "1" level. Accordingly, an output signal will be produced by OR gate 58 of division ratio indicating signal generating circuit 42, whose frequency will be determined by the particular combination of switches in frequency adjustment switch block 26 which have been set to the "1"

logic level potential. For the case shown in FIG. 1, in which a "1" level output is produced only from frequency adjustment switch 32, an output signal with a frequency equal to that of f3, i.e. 128 Hz is produced. Thus, for the combination of frequency adjustment switches 28 to 38 in which only switch 32 is closed, and the other frequency adjustment switches are open, the drive signals applied to the electrodes of liquid crystal display 22 will be modulated at a frequency of 128 Hz, when the timepiece is set in the running rate measurement mode.

As stated hereinabove, it is possible to determine the running rate of an electronic timepiece having a liquid crystal display, by utilizing an external capacitatively-coupled monitoring device such as that described in U.S. Pat. No. 3,964,591 by Yanagawa et al, if the modulation frequency of the liquid crystal display is periodic and is a submultiple of the standard frequency oscillator signal. (For consistency, the term "running rate," as used herein will be defined as the frequency of the unit time signal produced by the frequency divider circuit.) In this case, if the modulation frequency is 32 Hz, for example, then the differentiated signal which will be detected by the external monitoring device will be as shown in (A) of FIG. 2. As explained hereinabove, the modulation signal of a timepiece employing a frequency division ratio adjustment method such as that of the embodiment of FIG. 1 is not purely periodic, so that it is not practicable to determine the running rate by detection of the liquid crystal display modulation signal frequency. However, when the embodiment of FIG. 1 is set to the running rate measuring mode, then signal f3 is applied as a modulation signal to the liquid crystal display and can thus be detected by an external monitoring device, which will provide a signal of the form shown in (H) of FIG. 2. By determining the frequency of this detected signal, which will be almost precisely 128 Hz, it can be learned that only switch 32 of frequency adjustment switch block 26 is closed. In other words, by measuring the frequency of the liquid crystal display modulation signal in the running rate measuring mode, it is possible to determine the effective frequency division ratio, i.e. degree of frequency correction which is being performed by frequency division ratio adjustment circuit 24 when the timepiece is operating in the normal timekeeping mode. In addition, since the 128 Hz signal is purely periodic in nature, during the running rate measurement mode, and since it is an integral multiple of the standard frequency oscillator output signal, it is obviously possible to precisely determine the running rate of the timepiece (or the output frequency of standard frequency oscillator 10) by measuring the time duration To between a predetermined number of cycles of the liquid crystal display modulation frequency, when the timepiece is in the running rate measurement mode. It will be apparent that such determination of the running rate of the timepiece can be performed by automated equipment, making it highly suited to a mass production manufacturing process, and that all measurements can be performed without accessing the interior of the timepiece.

Figure 3:
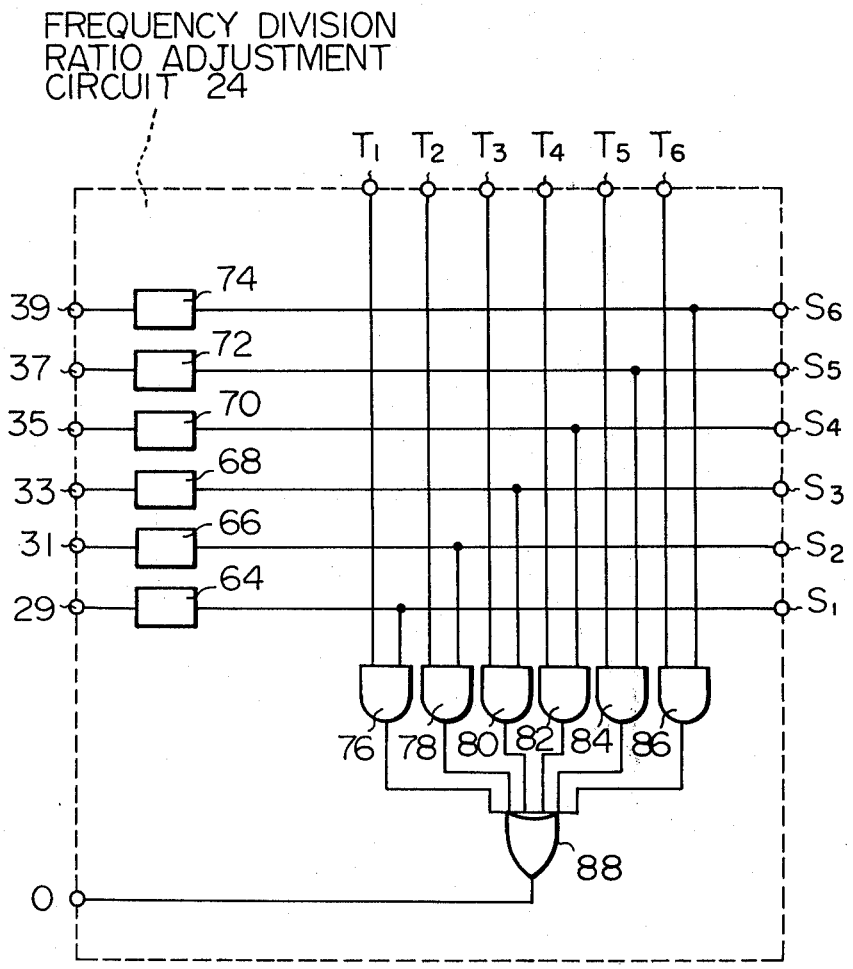
FIG. 3 is a circuit diagram of a frequency division ratio adjustment circuit block of the embodiment of FIG. 1.

An example of the frequency division ratio adjustment circuit 24 is shown in FIG. 3. Numerals 29, 31, 33, 35, 37 and 39 denote terminals which are coupled to switches 28, 30, 32, 34, 36 and 38 respectively in frequency adjustment switch block 26. Numerals 64 to 74 denote switch input circuits, provided to interface between the frequency adjustment switch signals and the integrated circuitry of the timepiece. Signals of various frequencies, produced by frequency divider circuit 14, are applied from terminals T1 to T6 to input terminals of a set of AND gates 76 to 86 respectively. Thus, AND gates **76*b* to 86 are enabled or inhibited from passing signals applied to terminals T1 to T6 respectively, in accordance with the open or closed condition of switches 28 to 38 respectively. The outputs from AND gates 76 to 86 are combined in an OR gate 88, the output from which constitutes the running rate correction signal Cr. The signals produced by frequency adjustment switches 28 to 38 are also applied through input circuits 64 to 74 respectively to terminals S1 to S6** respectively.

Figure 4:
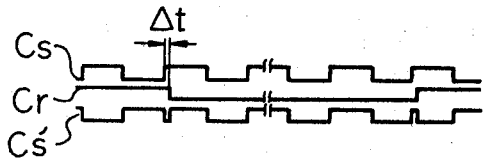
FIG. 4 is a waveform diagram illustrating the process of aperiodic frequency addition in a timepiece according to the present invention.

FIG. 4 is a waveform diagram illustrating the way in which aperiodic frequency addition is performed by exclusive-OR gate 12. As shown, while the running rate correction signal Cr from AND gate 40 is at a constant potential, the output signal from exclusive-OR gate 12, denotes as Cs', is identical to the output signal from standard frequency oscillator 10, denoted as Cs. However, each time a logic level transition of running rate correction signal Cr occurs, then a logic level transition also occurs in the signal Cs'. In this way, aperiodic incrementing of the frequency of the output signal from standard frequency oscillator 10 is performed in accordance with the frequency of running rate correction signal Cr.

Figure 5:
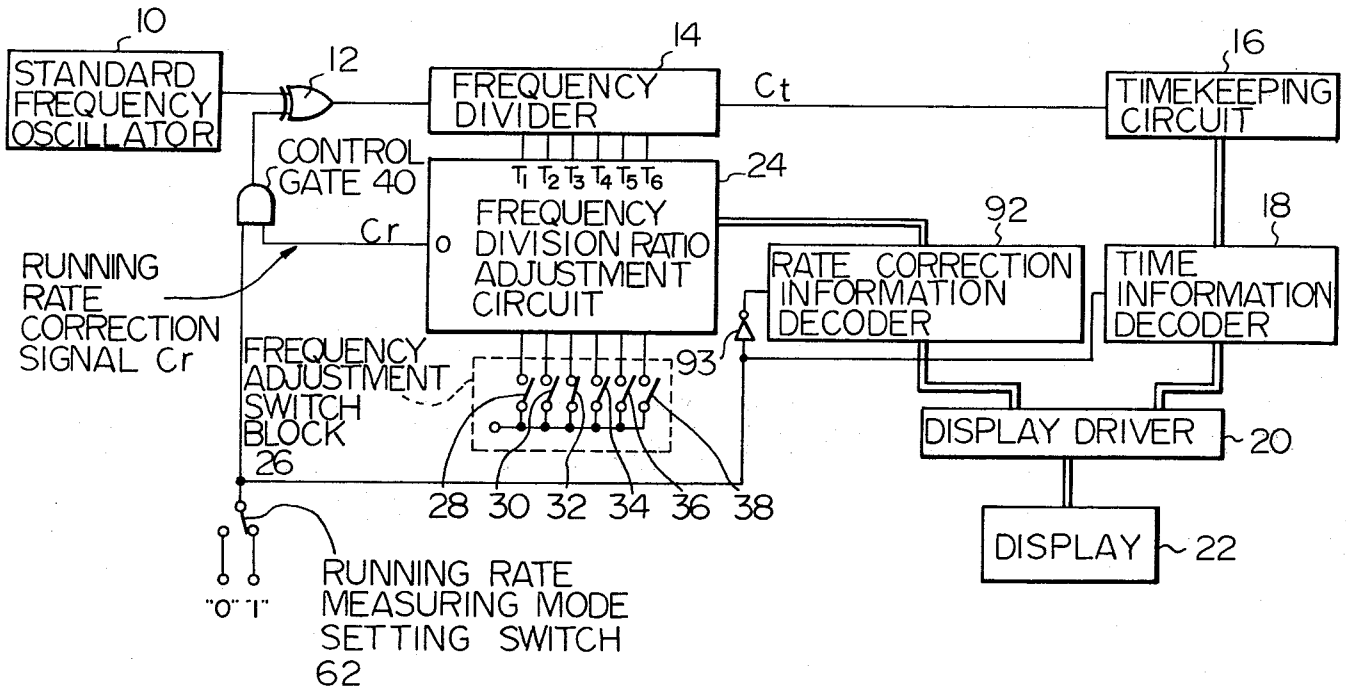
FIG. 5 is a block circuit diagram of the second embodiment of the present invention.
Figure 7:
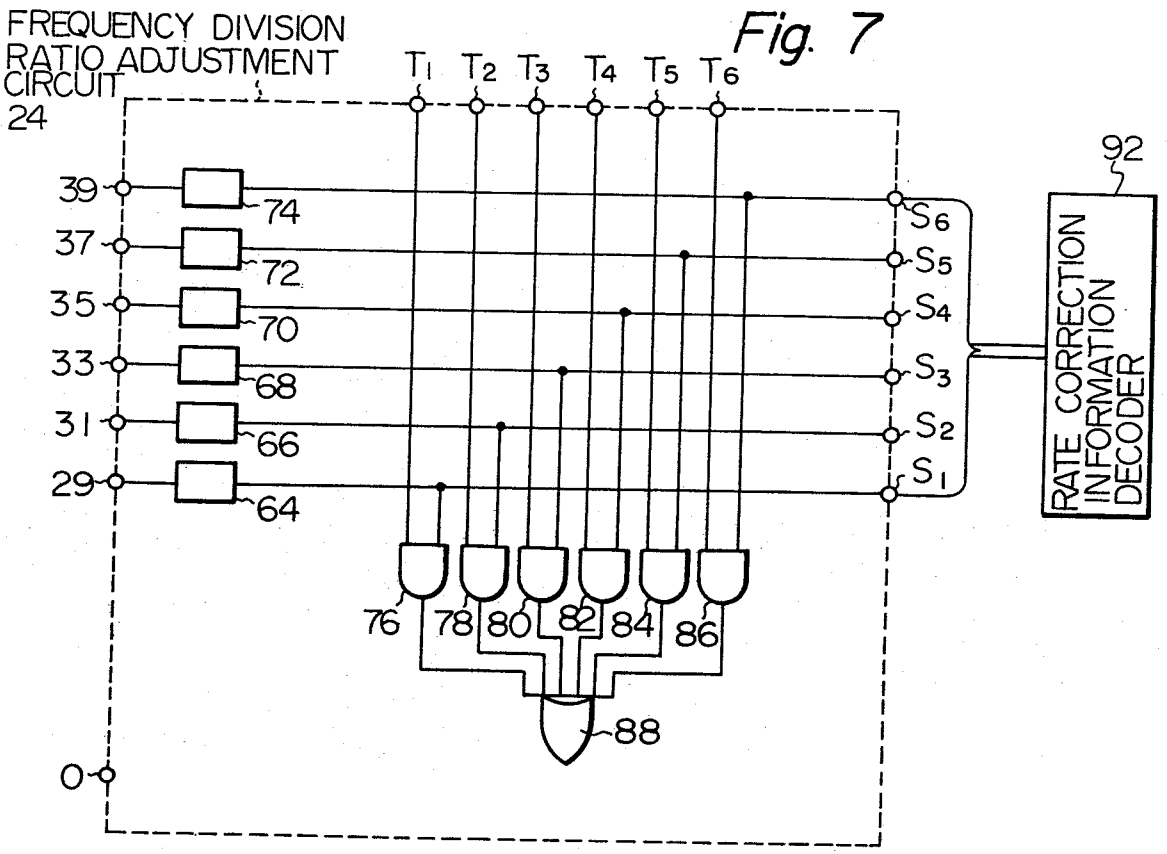
FIG. 7 is a circuit diagram of a frequency division ratio adjustment circuit in the circuit of FIG. 6.

Referring now to FIG. 5, a second embodiment of an electronic timepiece according to the present invention is shown. As in the case of the first embodiment, this comprises a standard frequency oscillator producing a signal which is aperiodically incremented in frequency by a running rate correction signal Cr, in an exclusive-OR gate 12, the output of which is applied to a frequency divider circuit 14. The functions of frequency division ratio adjustment circuit 24, frequency adjustment switch block 26, running rate correction signal Cr, time information decoder circuit 18, display driver circuit 20, and AND gate 40 are identical to those of correspondingly numbered circuits in the first embodiment of the present invention described above. However in this embodiment, as illustrated in FIG. 7, terminals S1 to S6 of frequency division ratio adjustment circuit 24 are applied to a rate correction information decoder circuit 92. The rate correction information decoder circuit 92 comprises a decoder and serves as a means for converting an information indicative of the effective division ratio of the frequency divider 14 into an information indicative of the running rate of the timepiece. The input and output terminals of an inverter 93 are coupled to control terminals D of time information decoder circuit 18 and rate correction information decoder circuit 92 respectively. The input terminal of inverter 93 is also coupled to running rate measuring mode setting switch 62. When the running rate measuring mode setting switch 62 is set to the normal timekeeping mode position, in which an "1" logic level output is produced therefrom, then the time information decoder circuit 18 is enabled. In this case, time information produced by timekeeping circuit 16 is displayed on liquid crystal display 22, as a result of drive signals from display driver circuit 20. When the running rate measuring mode setting switch 62 is set to the running rate measuring position, in which a "0" logic level output is produced therefrom, then time information decoder circuit 18 is inhibited from producing output signals, while rate correction information decoder circuit 92 is enabled. In this case, output signals will be produced from rate correction information decoder circuit 92 in accordance with the particular combination of logic level potentials appearing on terminals S1 to S6 of frequency division ratio adjustment circuit 24, i.e. in accordance with the combination of settings of frequency adjustment switches 28 to 38 which have been previously established to provide aperiodic correction of the running rate of the timepiece. The output signals from rate correction information decoder circuit 92 can be coded in various possible ways in order to provide a display of information on liquid crystal display 22 indicating the degree of frequency correction being provided by frequency division ratio adjustment circuit 24, i.e. the effective frequency division ratio in the normal timekeeping mode. For example, information can be displayed to indicate each of frequency adjustment switches 28 to 38, and whether each switch is in the open or closed condition. From this information, the degree of frequency correction of the timepiece running rate can be deduced. An alternative method is to arrange that the output signals from rate correction information decoder circuit 92 will result in the actual amount of running rate correction being directly displayed on liquid crystal display 22.

Figure 6A:
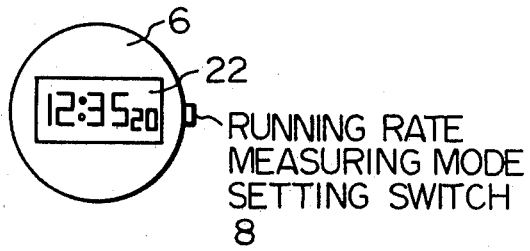
FIG. 6A and FIG. 6B show the external appearance of a display and external operating member of a second embodiment of an electronic timepiece according to the present invention, in a normal timekeeping mode of operation and in a running rate measurement mode of operation respectively.
Figure 6B:
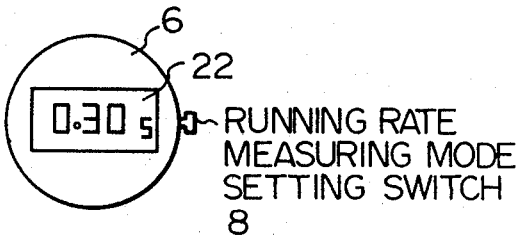

The latter method is illustrated in FIGS. 6A and 6B, which show the outer appearance (in simplified form) of the display dial 6 of an electronic timepiece according to the second embodiment, the body of the timepiece being equipped with an external operation member 8, which actuates running rate measuring mode setting switch 62. When external operating member 8 is in the inward position, as shown in FIG. 6A, then running rate measuring mode setting switch 62 is set to the normal timekeeping position, so that time information is displayed by liquid crystal display 22. When external operating member 8 is in the outward position, as shown in FIG. 6B, then running rate measuring mode setting switch 62 is set to the running rate measuring mode position, and in this case, the actual amount of running rate correction provided by frequency division ratio adjustment circuit 24 when the timepiece is in the normal timekeeping mode of operation is directly displayed. In the example of FIG. 6A, the degree of running rate correction is equivalent to 30 seconds per day.

It is also possible to arrange rate correction information decoder circuit 92 such that running rate correction information is displayed in some other form than those described hereinabove.

In the second embodiment of the present invention, the modulation signal applied to display driver circuit 20 has the same frequency (for example 32 Hz) in both the normal timekeeping mode and the running rate measurement mode of operation. In the running rate measurement mode, the frequency of the modulation signal can be measured by means of an external monitoring device such as has been described hereinabove. In this case, a signal as illustrated in (A) of FIG. 2 will be produced by the external monitoring device. Since this signal is periodic, in the running rate measurement mode of operation (in which control gate 40 is inhibited), and its frequency is an integral submultiple of that of the output signal from standard frequency oscillator 10, the latter frequency can thus be determined. And, since the degree of running rate correction performed by frequency division ratio adjustment circuit 24 is indicated on liquid crystal display 22, it will be apparent that the actual running rate of the timepiece when in the normal timekeeping mode of operation can be readily obtained, as in the case of the first embodiment described above.

The present invention is also applicable to an electronic timepiece utilizing a stepping motor which drives time indicating hands. In this case, the operation of the stepping motor by drive signal produced from a unit time signal can be inhibited when the mode setting switch 62 is set to the running rate measuring mode. A drive signal can then be applied to advance the timekeeping hands at a rate which indicates the amount of running rate adjustment performed by frequency division ratio adjustment circuit 24. This frequency can be determined by means of an external monitoring device which is coupled magnetically to the drive coil of the stepping motor, for example. From the frequency of the signal thus detected, and measurement of the duration of a predetermined number of cycles of that signal, the actual running rate of the timepiece in the normal timekeeping mode can be obtained, as in the case of the first two embodiments of the present invention described above.

If such a method is adopted, then a memory circuit can be included in the timepiece, to store the number of cycles of the unit time signal which occur during the running rate measuring mode. When the running rate measuring mode setting switch 62 is subsequently returned to the normal timekeeping mode, then the contents of the memory circuit can be used to rapidly advance the time indicating hands to the correct time. It is also possible to provide a display area on the timepiece dial having an electro-optical display device, for example, which is used to display information on the degree of running rate correction performed, or the effective division ratio.

From the above description of the preferred embodiments, it will be apparent that the present invention overcomes a major disadvantage which has been encountered before now in the practical utilization of an electronic timepiece in which running rate correction is performed by aperiodic frequency incrementation, namely, the difficulty of rapidly and accurately determining the actual running rate of such a timepiece. With an electronic timepiece according to the present invention, the timepiece can be instantly put into an operating condition in which aperiodic frequency incrementation is interrupted, so that the frequency of the signal produced by the standard frequency oscillator of the timepiece can be readily determined, by such mens as monitoring a low frequency signal such as a modulation signal applied to an electro-optical display device, this low frequency signal being periodic and an integral submultiple of the frequency provided by the standard frequency oscillator circuit of the timepiece. The present invention also enables the frequency of a running rate correction signal, which is aperiodically added in frequency to the standard frequency oscillator output signal, to be readily determined, either directly or indirectly, i.e. by utilizing the timepiece display or by utilizing an external frequency monitoring device. From the information thus obtained, the actual running rate of the timepiece can be derived, to a high degree of accuracy.

From the preceding description, it will be apparent that the objectives set forth for the present invention are effectively attained. Since various changes and modifications to the above construction may be made without departing from the spirit and scope of the present invention, it is intended that all matter contained in the above description or shown in the accompanying drawings shall be interpreted as illustrative, and not in a limiting sense. The appended claims are intended to cover all of the generic and specific features of the invention described herein.

What is claimed is:

1. An electronic timepiece having a source of a standard frequency signal, a frequency divider circuit for dividing the frequency of said standard frequency signal to provide a unit time signal, timekeeping means responsive to said unit time signal for producing time information, display means for displaying said time information, and means for controlling the effective frequency division ratio of said frequency divider by aperiodic frequency algebraical addition of a running rate correction signal to said standard frequency signal, the improvement comprising:

mode setting means for selectively setting said electronic timepiece in a normal timekeeping mode in which said aperiodic frequency algebraical addition is performed and in a running rate measuring mode in which said aperiodic frequency algebraical addition in inhibited; and circuit means for generating an electrical signal in said running rate measuring mode indicative of said effective frequency division ratio of the frequency divider in said normal timekeeping mode.

2. The improvement according to claim 1, in which said mode setting means comprises an externally actuated running rate measuring mode setting switch, and a control gate coupled to receive said running rate correction signal and responsive to signals produced by said running rate measuring mode setting switch for selectively inhibiting trasfer of said running rate correction signal to be aperiodically added to said standard frequency signal in said running rate measuring mode and transferring said running rate correction signal to be aperiodically added to said standard frequency signal in said normal timekeeping mode.

3. The improvement according to claim 1, in which said electrical signal indicative of said effective frequency division ratio of the frequency divider comprises a periodically modulated signal having a frequency which is predetermined to be indicative of the value of said effective frequency division ratio.

4. The improvement according to claim 3, further comprising circuit means responsive to the signals produced by said running rate measuring mode setting switch to provide said periodically modulated signal having the frequency which is predetermined to be indicative of the value of said effective frequency division ratio.

5. The improvement according to claim 1, and further comprising circuit means coupled to receive said signal indicative of the effective division ratio of said frequency divider, and coupled to said display means, whereby information indicative of said effective division ratio of the frequency divider in said normal timekeeping mode is displayed by said display during said running rate measuring mode.

6. The improvement according to claim 4, in which said information indicative of the effective division ratio is a running rate of the electronic timepiece.

7. The improvement according to claim 4, wherein said display means comprises an electro-optical display device driven by a display driver circuit, and wherein said circuit means coupled to recieve said division ratio indicating signal comprises a decoder circuit, the operation of which is enabled in said running rate measuring mode and is inhibited in said normal timekeeping mode.

* * * * *